US006186931B1

(12) United States Patent
Calvert et al.

(10) Patent No.: US 6,186,931 B1
(45) Date of Patent: Feb. 13, 2001

(54) TRAY ERECTOR

(75) Inventors: Rodney K. Calvert, Dunwoody; Robert L. Dover, Marietta, both of GA (US)

(73) Assignee: Laminating Technologies, Inc., Atlanta, GA (US)

( * ) Notice: Under 35 U.S.C. 154(b), the term of this patent shall be extended for 0 days.

(21) Appl. No.: 09/259,618

(22) Filed: Mar. 1, 1999

(51) Int. Cl.[7] ..... B31B 1/00

(52) U.S. Cl. ..... 493/8; 493/137; 493/136; 493/38

(58) Field of Search ..... 493/52, 55, 137, 493/136, 140, 309, 316, 317, 8, 10, 38

(56) References Cited

U.S. PATENT DOCUMENTS

| | | | | |
|---|---|---|---|---|
| 2,921,506 | * | 1/1960 | Johnson | 493/140 |
| 3,811,368 | * | 5/1974 | Bragaglia et al. | 493/137 |
| 3,948,152 | * | 4/1976 | Nolan et al. | 493/8 |
| 4,498,567 | * | 2/1985 | Aultz et al. | 493/38 |
| 4,512,756 | * | 4/1985 | Fields | 493/312 |
| 4,586,916 | * | 5/1986 | Williams et al. | 493/10 |
| 4,626,234 | | 12/1986 | Oxborrow . | |
| 4,632,302 | | 12/1986 | Manizza . | |
| 4,705,173 | | 11/1987 | Forbers, Jr. . | |
| 4,757,937 | | 7/1988 | Maio et al. . | |
| 4,832,257 | | 5/1989 | Wood . | |
| 4,844,331 | | 7/1989 | Oldfather . | |
| 4,892,513 | | 1/1990 | Kwiek . | |
| 5,059,165 | * | 10/1991 | Wallin | 493/137 |
| 5,147,268 | * | 9/1992 | Cermeno | 493/38 |
| 5,156,582 | | 10/1992 | Thompson . | |
| 5,369,938 | * | 12/1994 | Panveno et al. | 493/10 |
| 5,372,569 | * | 12/1994 | Ballos, III | 493/316 |
| 5,624,031 | * | 4/1997 | Fowler et al. | 493/137 |

* cited by examiner

*Primary Examiner*—Eugene Kim
(74) *Attorney, Agent, or Firm*—Harold L. Marquis; Ryan A. Schneider; Troutman Sanders LLP

(57) ABSTRACT

The present invention provides an apparatus that can erect a tray from a generally flat, rectangular blank. The tray erector incorporates an inventory section, a transfer section, a construction section and an exit section. The inventory section has a hopper with flanges and tab stops, which hopper stores an inventory of stacked, flat blanks that will eventually become the trays. In the transfer section, a blank is transferred from the inventory section to the construction section of the present erector. The construction section includes a setup assembly and a locking assembly. The setup assembly folds the pre-cut and scored end and side panels of the tray blank up into approximately perpendicular planes in relation to the plane of the bottom panel of the blank. The end and side panels are folded up from the plane of the bottom panel of the blank in preparation for the locking of the corner webs. While the end and side panels are folded, the corner webs begin to extend out from the tray due to the actions of folding the end and side panels. The locking assembly of the construction section completes the remaining tray folding and locking steps, and an erected tray is produced. This includes folding the web corners against the end panels, and locking the web corners to form the finished tray. The erected tray then drops from the construction section to the exit section, where the tray is guided onto a conveying device, preferably a moving delivery conveyor belt.

24 Claims, 11 Drawing Sheets

TRAY ERECTOR

BACKGROUND OF THE INVENTION

1. Field of the Invention

The present invention relates generally to a paperboard carton erector capable of preparing a folded carton from a flat blank, and relates more specifically to an automated erector that folds a flat, die-cut blank of laminated paperboard or corrugated paperboard into a tray, which tray can be used for baking, shipping and storing food and other products. The present invention erects shallow, open-top trays having leakproof corner constructions. The design and folding of the blank eliminates the need for gluing, taping and the like to lock the tray's walls in an upright configuration.

2. Description of Related Art

Conventional foldable cartons are well known and are used worldwide in a variety of applications. For example, the packaging industry utilizes a vast number of cartons in which numerous products are packaged for subsequent shipment. Similarly, a variety of automated carton erectors exist for folding cartons. Foldable cardboard carton erector devices are known for setting up folded carton or box blanks, closing their bottom flaps, and sealing the bottom flaps so the carton can be loaded. Many of the cartons folded by a box erector are commonly referred to as slotted boxes or cases known as a RSC (regular slotted case). These cartons are shipped to a packaging company as stacks of flat collapsed blanks for ease of handling and shipment. After arriving at the packaging company, the blanks are placed into a box erecting apparatus, usually located immediately adjacent a packaging machine. Box erectors automatically remove collapsed boxes individually from a magazine and by various mechanisms, move a box to an unfolded open position, immediately after which the erector automatically moves a pair of minor and major closure flaps on the bottom of the box into a closed position so the box, upon reaching the end of the erector, is in a top open position so that any articles to be contained therein can be inserted manually or automatically into the open top of the erected box. Yet these box devices are not entirely suitable, particularly because they are relatively complicated in construction, and require a large amount of floor space.

These types of disadvantages similarly plague conventional tray erecting devices. Automated construction of foldable trays has been limited primarily to the high-speed production of like trays of the same size. For example, six-pack trays with or without a shrink wrap assist are well known and are produced in high speed and great volume. These types of trays are designed to retain the lower portion of the containers by providing a bottom and four secured sides. While these sides may be secured by a binding means like staples, adhesive is conventionally preferred since the tray is thus much more rigid and the possibility of injury to one's hand during emptying is greatly reduced.

The conventional binding method uses a thermally sealable coating on the carton blank. The places that are to be fastened together are coated and heated by hot air, and thereafter these places are subjected to pressure by clamping jaws, clamping rollers or the like. During erection of these types of trays, the sides or flaps are laid one above the other and fastened by the heat and pressure.

Trays also can be erected by hand, versus automatically, although this method requires both more manpower and more floor space than needed with an automated tray erector.

Typical tray construction begins by manipulating a scored flat sheet or blank. While there may or may not be cutouts in the tray blank providing grip assists for lifting the tray, tray blanks generally have cutout portions that provide tabs that are folded to secure end and side walls. Conventionally, the erected tray has the side and end walls of substantially the same height.

In the conventional erection of a rectangular tray-type carton from a flat blank, it is known to fold the end and side wall panels of the carton approximately perpendicular from the bottom panel of the carton, and then to secure those panels in their desired formation by means of folded gussets formed from gusset panels which join the end and side wall panels integrally together.

Foldable paperboard and corrugated paperboard trays have been developed for a variety of uses, and have been found to provide an economical means for storing and transporting a variety of products. For example, disposable concession trays, such as those disclosed by U.S. Pat. No. 4,705,173 to Forbes, Jr. and U.S. Pat. No. 4,757,937 to Maio, et al., have been found to provide inexpensive and disposable containers for transporting food and drink. These foldable paperboard containers are typically fabricated from a die-cut paperboard blank, and can be stored in a flat configuration, in order to minimize space requirements during shipping and prior to their use by the consumer. The paperboard blanks are typically configured in a manner that permits quick and easy assembly into their erected configurations when placed into use. Unless otherwise indicated, the term "paperboard" herein will also include corrugated paperboard.

The nature of paperboard and corrugated paperboard cartons, however, limit their use to post-preparation storage and handling of most food products. For example, typical paperboard and corrugated paperboard are generally inadequate for use during the baking or cooking of food items, as the materials from which they are constructed will burn or char at elevated temperatures. A shallow wall baking tray is disclosed by U.S. Pate. No. 4,632,302 to Manizza.

Moreover, the structural configuration of many known foldable paperboard or corrugated paperboard containers prevents the containers from being utilized in applications where fluid contents are introduced into the container. In particular, the corner construction of many known foldable paperboard or corrugated paperboard containers includes slits or openings in the blank to facilitate the formation of corners or locking panels when the blank is folded into its assembled configuration. Thus, if fluid contents are introduced into the assembled container, the contents will leak from the container.

For example, the Manizza '302 patent shows a folded panel baking tray wherein the tray's corners comprise an open slot between upright sidewalls, resulting from the tray's assembly from a blank having a generally rectangular corner cutout. When the blank of the Manizza reference is foldably assembled to form a shallow tray, adjacent edges of the sidewall panels at this corner cutout form a slotted corner which is incapable of retaining fluid contents. Moreover, the C-shaped or caddie cuts required along the base panel of the Manizza tray present further openings from which fluid contents can leak. It has also been recognized that containers such as that disclosed by the Manizza reference suffer the further disadvantage that gluing of certain panels is necessary to assemble the container. Such gluing results in additional time and expense to assemble the container, and is preferably avoided.

U.S. Pat. No. 4,844,331 to Oldfather discloses another variety of foldably assembled container. This container includes a corner assembly formed by a slit in the die blank that may permit any fluid content to leak. In addition, a slot is cut into the main panel of this assembly near its corner to receive a locking tab for retaining the structure in its assembled configuration. This slot, owing to its location adjacent the floor of the assembled container presents a further point of potential leakage of fluid contents.

U.S. Pat. No. 4,832,257 to Wood shows a paperboard tray having folded corners requiring no cut lines or openings. However, in order to retain this tray in its assembled configuration, it is necessary to adhesively secure the corner assemblies in their upright configuration. The necessity of gluing disadvantageously requires additional time and expense in the assembly of this tray. Also, because the corner assemblies must be glued to retain the tray in its upright configuration, the tray cannot readily be knocked down into a generally flat configuration for more easy access to the contents of the tray, without substantially damaging the tray. Thus, the tray disclosed by this reference is not suitable for applications in which it is desired to periodically disassemble and reassemble the tray. Moreover, the corner assemblies of this variety of tray are typically glued in the assembled configuration at their point of manufacture. Therefore, the blanks cannot be shipped to their point of use in a flat, unfolded configuration.

Therefore, it can be seen that a need yet exists for a compact and efficient automated erector for constructing a paperboard or corrugated paperboard tray container, which tray can be used for baking, shipping and storing food and other products. The tray should be foldably constructed from a flat, die-cut blank, and should enable fluid contents to be contained therein without the use of glue that can liquefy upon heating in an oven.

BRIEF SUMMARY OF THE INVENTION

Briefly described, in its preferred form, the present invention provides an apparatus that can erect a tray from a generally flat, rectangular blank. The typical blank manipulated by the present erector generally comprises: a bottom panel bounded by first and second end score lines and first and second side score lines; first and second end panels connected to the opposite ends of the bottom panel at the first and second end score lines; first and second side panels connected to the opposite sides of the bottom panel at the first and second side score lines; and, corner webs or gussets adjacent each corner of the bottom panel between adjacent end and side panels.

The blank further preferably comprises a heat-resistant laminate of paperboard or corrugated paperboard and an inner and/or outer liner of heat-resistant, leakproof material. The preferred liner material is a polyester film bonded by polyethylene to the paperboard material.

The erected tray has leak-proof corner assemblies wherein a tab portion of each corner is folded against the tray's exterior and engaged within a retaining slit in the end panel of the tray when a flap portion of the end panel is folded over the corner tab. The slit retains the corner tab and maintains the tray in its assembled configuration. This "roll-over lock," being formed to the tray's exterior, does not interfere with the use of the tray's interior space, and provides a convenient "handle" by which to grasp the assembled tray. In the tray's assembled configuration, the retaining slit is adjacent to the top edge of the tray's end wall, where the retaining slit does not present a lower opening from which fluid contents can leak from the tray.

The tray erector of the present invention comprises an inventory section, a transfer section, a construction section and an exit section. The inventory section preferably includes a hopper having flanges and tab stops, which hopper stores an inventory of stacked, flat blanks that will eventually become the trays. Each blank has both an outside and inside face. Upon manipulation, the outside face of the blank forms the outside surface of the tray. The inside face of the blank, which preferably is laminated, forms the interior surfaces of the constructed tray. The inventory section of the erector is preferably the uppermost portion of the erector, as the various sections lie vertically.

In the transfer section of the present erector, a blank is transferred from the inventory section to the construction section of the present erector. The transfer section includes a transfer mechanism and a grasping mechanism both to grasp a bottom blank from the inventory section, and then transfer the bottom blank to a release position situated over the construction section. The blank is released from the grasping mechanism at the release position and slides down to, and rests atop, a stop member in the construction section. Thus, the bottom blank is transferred from a stacked position in the inventory section into a tray-construction position in the construction section. Generally, the blank travels down through the present invention from the release position through to the exit section by means of gravity feed.

The construction section includes a setup assembly and a locking assembly. The setup assembly folds the pre-cut and scored end and side panels of the tray blank up into approximately perpendicular planes in relation to the plane of the bottom panel of the blank. The end and side panels are folded up from the plane of the bottom panel of the blank in preparation for the locking of the corner webs. While the end and side panels are being folded, the corner webs begin to extend out from the tray due to the actions of folding the end and side panels.

The locking assembly of the construction section completes the remaining tray folding and locking steps, and an erected tray is produced. This includes folding the web corners against the end panels, and locking the web corners to form the finished tray.

The erected tray then drops from the construction section to the exit section, where the tray is guided onto a conveying device, preferably a moving delivery conveyor belt.

The present device is automatic and only requires an attendant to replenish the tray hopper and insure that jams do not occur or are freed in short order. Additionally, a trained attendant performs the adjusting of size for product changes.

Accordingly, an object of the invention is to provide a tray erecting apparatus for foldably constructing a unitary blank into an open top container, wherein the blank preferably comprises: a generally rectangular bottom panel; first and second side panels connected to opposite sides of the bottom panel; first and second end panels connected to opposite ends of the bottom panel; and corner webs or gussets continuously connecting adjacent side panels and end panels.

Another object of the invention is to provide a tray erector that can be utilized to erect different size trays without undergoing extensive retooling.

Yet another object of the invention is to provide a tray erector which erects trays taken from an inventory of stacked blanks in a smooth and reliable manner.

It is a further object of the present invention to provide a tray erector that can erect a tray-shaped paperboard or corrugated board laminated container, which container prevents the leakage of fluid contents such as cake batter.

These and other objects, features and advantages of the present invention will become more apparent upon reading the following specification in conjunction with the accompanying drawing figures.

DETAILED DESCRIPTION OF A PREFERRED EMBODIMENT

Briefly described, in its preferred form, the present invention provides an apparatus for erecting a generally rectangular tray from a blank. The description of preferred tray erectors of the present invention follows the description of preferred blanks manipulated by the erectors. In this manner, the erector descriptions of the present invention will be clearer as the erector descriptions can relate to the manipulation of specific elements of the blank and tray.

The Blank

Figure 1:
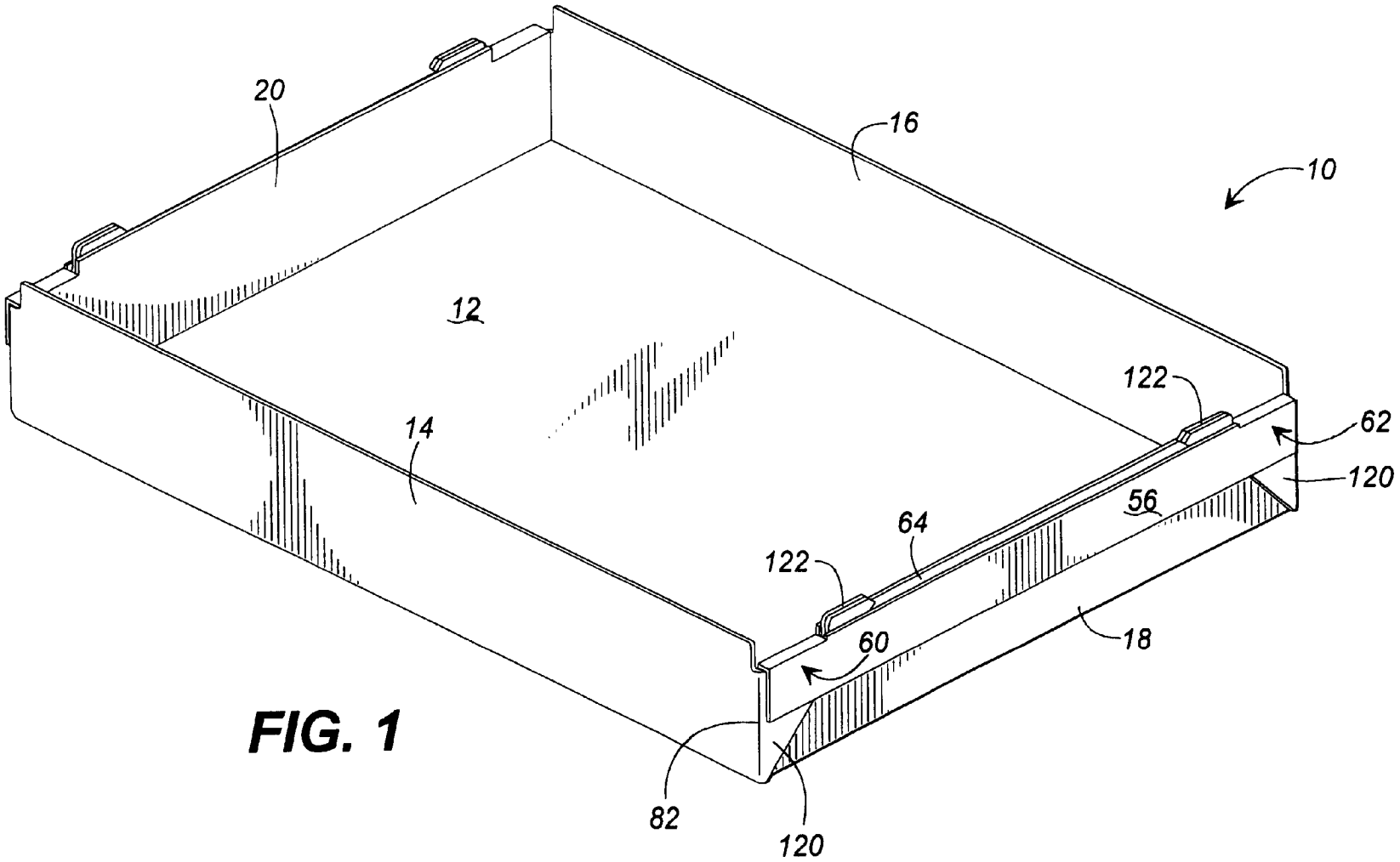
FIG. 1 shows a foldable laminated corrugated paperboard container constructed by the present invention, according to a preferred form, in its assembled configuration.

Referring now in detail to the drawing figures, wherein like reference numerals represent like parts throughout the several views, FIG. 1 shows an erected open top container produced by the present invention, which container generally comprises an open-top tray or tray 10 having a bottom 12, first and second side walls 14, 16 and first and second end walls 18, 20. Thus defined, the baking tray 10 comprises a generally rectangular, open-top box.

Figure 3:
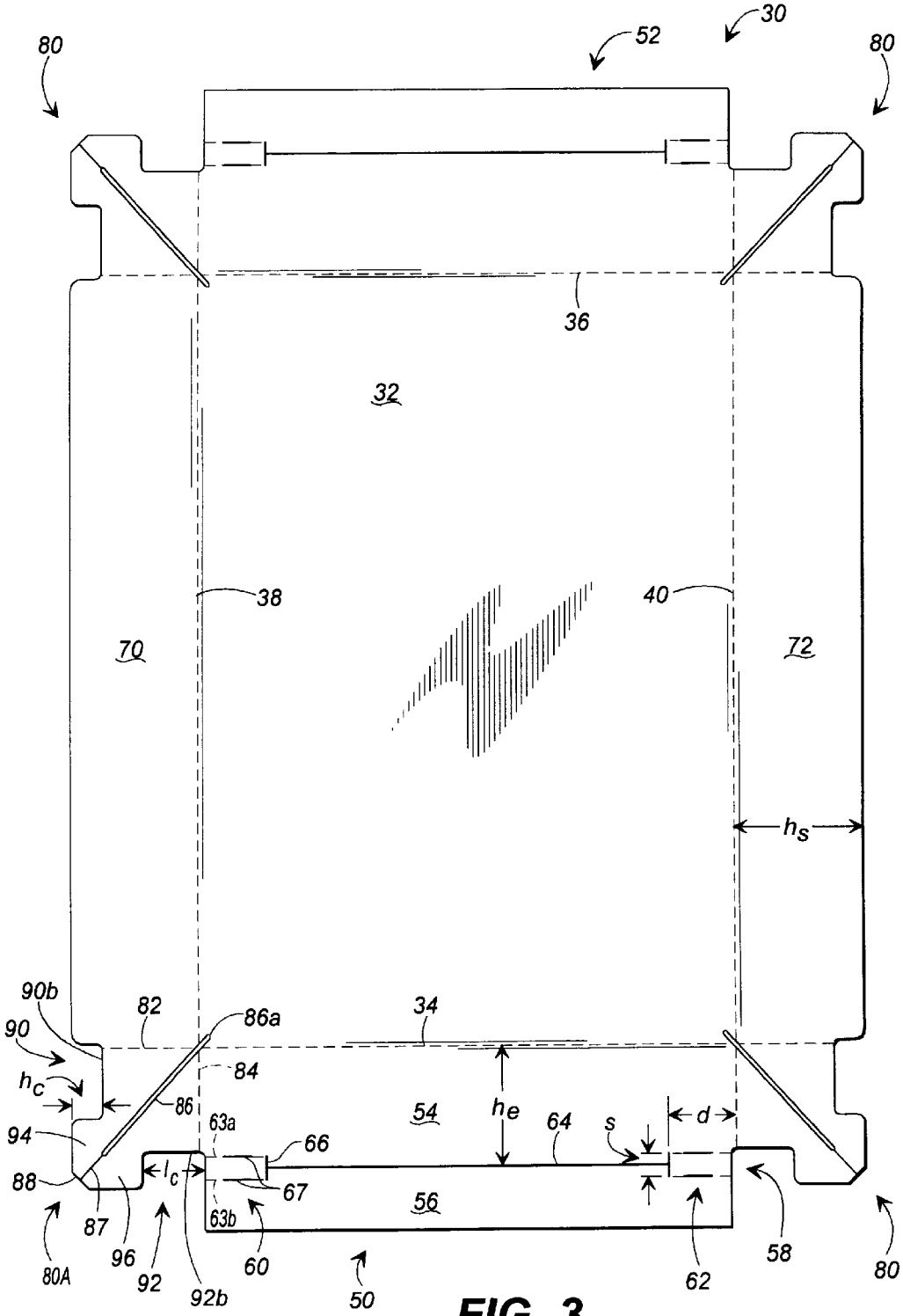
FIG. 3 shows a laminated corrugated paperboard blank of the container of FIG. 1.

The baking tray 10 is constructed by folding a one-piece blank 30, which is shown in preferred form by FIG. 3. The blank 30 is die cut and scored, according to known techniques, from a flat sheet of heat-resistant laminated paperboard or corrugated paperboard having a laminated linerboard, which material will be described in greater detail below.

The blank 30 generally comprises a bottom panel 32 having a top face and a bottom face, which, when the blank 30 is foldably assembled to form the baking tray 10, forms the bottom 12 of the baking tray 10. The bottom panel 32 is generally rectangular, and is bounded by first and second end score lines 34, 36, and first and second side score lines 38, 40.

The blank 30 further comprises first and second end panels 50, 52, connected to the opposite ends of bottom panel 32 at first and second end score lines 34, 36, respectively. When the blank 30 is foldably assembled to form the baking tray 10, the first and second end panels 50, 52 form the first and second end walls 18, 20, respectively, of the baking sheet 10. The first and second end panels 50, 52 are generally identical mirror images of one another and, therefore, for purposes of brevity, only the first end panel 50 will be described in detail. It will be understood that the second end panel 52 is of similar construction to that described. First end panel 50 preferably comprises an end wall panel 54 and a flap panel 56, connected to one another by means of a hinged fold joint 58, which will be described in greater detail below. End wall panel 54 is generally rectangular, having a width equal to that of the bottom panel 32, and a height he generally corresponding to the desired wall height $h_e$ of the side walls 70, 72 of the baking tray 10.

The hinged fold joint 58 comprises perforated sections 60, 62 at each end of the abutting line between the end wall panel 54 and the flap panel 56, and further comprises a retaining slit 64 extending between the perforated sections 60, 62 along the central portion of the line of connection between the end wall panel 54 and the flap panel 56. The perforated sections 60, 62 each comprise a generally parallel pair of perforations or score lines 63*a*, 63*b*, the perforations or score lines being spaced apart from one another a distance s, at least approximately twice the thickness of the laminated paperboard or corrugated paperboard comprising the blank 30, and preferably approximately four times the thickness of the laminated paperboard forming the blank 30 for ease of erecting the tray 10. Each of the parallel perforations or score lines 63*a*, 63*b* is of a length d. To facilitate the folding of the tray and the locking of the locks, a knifecut 66 can be provided between the interior ends of the perforations 63*a*, 63*b*.

The perforated sections 60, 62 can also have knifecuts 67 centered along perforations 63*a* and 63*b* to ensure the proper locking and holding position of the locked baking tray 10.

It will be evident that if the blank 30 is comprised simply of fold lines, and had no knifecut portions, any tray formed of blank 30 could retain liquid only to the height of the shortest panel. For example, if blank 30 did not include perforated sections 60, 62, upon assembly blank 30 would be leakproof up to a height $h_e$ or $h_s$, depending on which of these heights was shortest as measured from the respective score lines 34, 40.

The retaining slit 64 extends along the central portion of the abutting line between the end wall panel 54 and the flap panel 56, from the approximate midpoint of the knifecut 66 at the interior end of each perforated section 60, 62. Although the embodiment depicted by FIG. 3 shows the retaining slit 64 extending along the entire central portion of the abutting line between the end wall panel 54 and the flap panel 56 between the perforated sections 60, 62, one or more additional perforated sections, of similar construction to those described above can be provided along the central portion of the line of connection between the end wall panel 54 and the flap panel 56, in order to prevent excessive spread of the retaining slit 64 when the blank 30 is assembled to form the baking tray 10.

The blank 30 further comprises a first side panel 70 and a second side panel 72 which, when the blank 30 is foldably constructed into the baking tray 10, forms its first side wall 14 and second side wall 16, respectively. The first and second side panels 70, 72 connect to the bottom panel 32 at first and second side score lines 38, 40, respectively. The first and second side panels 70, 72 are generally rectangular, having a length equal to that of the bottom panel 32, and a height $h_s$ corresponding to the desired wall height of the side walls 14, 16 and approximately equal to the height he of the end wall panels 54.

Figure 4:
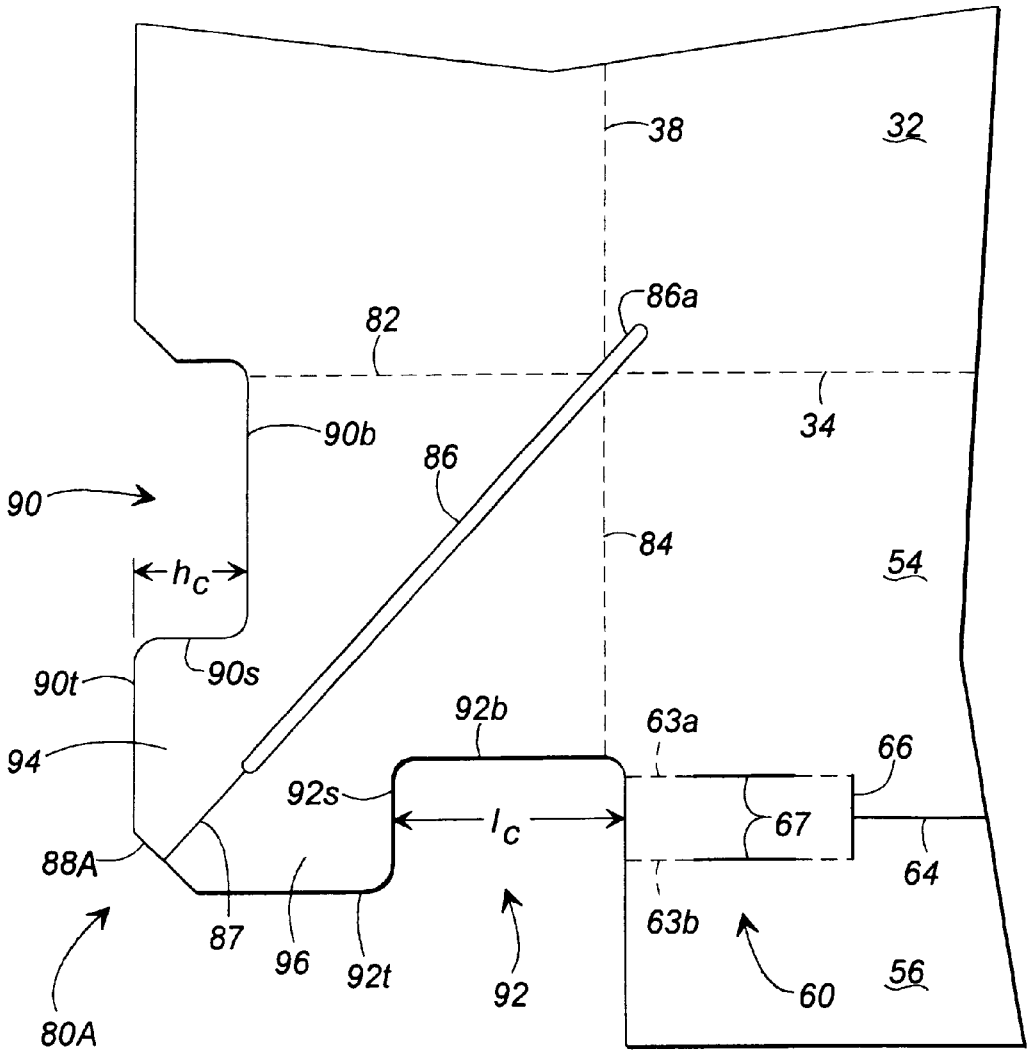
FIG. 4 illustrates a preferred corner web or gusset of the blank of FIG. 3.

The blank 30 preferably further comprises corner webs or gussets 80, adjacent each corner of the bottom panel 32 between an adjacent end wall panel and a side panel. The four corner webs 80 are generally identical and, therefore, for purposes of brevity, only a single representative corner web 80A will be described in detail. As shown in FIG. 4, the corner web 80A connects to side panel 70 at a score line 82, and connects to end wall panel 54 at a score line 84. A diagonal score line 86 extends centrally along the corner web 80A, between the adjoining corner of the bottom panel 32 and an outer corner 88 of the corner web 80A as shown in FIG. 3. Alternatively, the outer corner may be a truncated corner 88A, as shown in FIG. 4. In a preferred embodiment, the score line 86 extends a distance through the juncture of score lines 34, 38 and into bottom panel 32, as shown by extension 86*a* of score line 86. Additionally, for ease in erecting the tray 10, score line 86 can have a knifecut portion 87 provided near the outer corner 88A of corner web 80A.

Generally rectangular cutouts 90, 92 are provided along each exterior edge of the corner web 80A, to form top locks 94, 96, respectively. Each cutout 90, 92 is of a length $I_c$, which is preferably incrementally greater than the length d of the respective perforated sections 60, 62 of the end panel 50 to provide clearance for the top locks 94, 96 to engage the retaining slit 64 during assembly. The cutouts 90, 92 are preferably of a height $h_c$ from bottom cutout lines or bottom edges 90*b*, 92*b* to top edges 90*t*, 92*t*. Top locks 94, 96 can be separated by knifecut portion 87 and score line 86, or just by score line 86. Thus described, it can be seen that the corner webs 80 are generally symmetric about the diagonal score line 86.

Bottom edge 92*b* is preferably incrementally nearer score line 82 than perforation 63*a* is to score line 34, so that the flap panel 56 can be folded about the perforations 63*a*, 63*b* during assembly, without interference from the corner web 80A. Thus as described before, the height at which the present tray 10 is leakproof is that height from score lines 34, 38 to bottom edges 92*b*, 90*b*, respectively. Since, upon construction of the tray 10, that height is only incrementally less than the height of the end walls 18, 20, the present tray 10 provides leakproof assembly to nearly the height of the end walls 18, 20 which height is easy to visualize by the user.

In one preferred embodiment of corner web 80A, perforations 63*a* and 63*b* are approximately ⅜ inches apart, perforation 63*a* is approximately ⅛ inch above bottom edge 92*b*, and retaining slit 64 is approximately 5/16 inches above bottom edge 92*b*. Further, while bottom edge 90*b* can be perpendicular to side edge 90*s* and parallel to top edge 90*t*, in preferred form side edge 90*s* is angled approximately 98 degrees from bottom edge 90*b*, and substantially perpendicular to top edge 90*t*. It will be understood that the above ranges of measurements are preferred ranges.

The present tray 10 provides an easily disassembled roll-over lock so that products in the tray 10 can be removed without deformation of the product by moving the sides and ends of the tray 10 back down into the flat blank 30 configuration. The roll-over lock requires only a purposely directed, gentle urging to unlock the sides and ends of the tray 10. To remove a baked product from the tray 10, for example a cake, one need simply fold the side and end wall panels down. Thus, one does not need to place a spatula or the like at side, end or corner locations to "scoop out" a portion of the baked food product.

Figure 5:
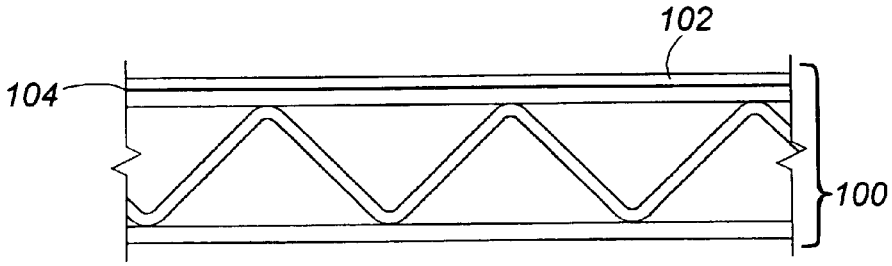
FIG. 5 shows a cross-sectional detail of a laminated corrugated paperboard of the blank of FIG. 3.

The blank 30 preferably comprises a heat-resistant laminated paperboard or corrugated paperboard. Preferably corrugated paperboard known by the name E-flute is used, however, the blank 30 can be fabricated from any of a variety of foldable paperboard, cardboard, or other materials. In order to provide a leakproof and heat-resistant container, the material comprising the blank 30 is preferably a laminated composite including a layer of plastic film bonded to the paperboard, cardboard, or other material of construction. The laminated composite material comprising the blank 30 is shown, according to one preferred form, by FIG. 5. As depicted, a corrugated paperboard stock 100 is provided with a layer of plastic film 102 on at least one of its faces. In most preferred form, the plastic film layer 102 will be provided on the interior of the assembled baking sheet 10 to prevent liquid content from being absorbed by, or from leaking through the baking sheet 10. Alternatively, the plastic film layer 102 can be provided on the exterior of the baking sheet 10, or on both the interior and exterior thereof In its preferred form, the tray 10 comprises a composite material of corrugated paperboard having a layer of bi-oriented polyester film bonded thereto through the use of a polyethylene bonding agent 104. U.S. Pat. No. 5,772,819 to Olvey, the teaching of which is incorporated herein by reference, discloses such a composite material, and a method of making said material.

The composite laminate material preferably comprising the blank 30 of the tray 10 is fabricated by passing a web of paperboard or kraft paper and a web of plastic film such as a bi-oriented polyester through the nip of a pair of nip rolls, extruding a molten plastic impregnating and bonding agent, such as polyethylene, at an elevated temperature of approximately 600° F. into the nip between the paper and plastic film webs, such that part of the molten plastic agent impregnates partially into and becomes part of the paper web and a portion of the plastic agent extends outwardly of the paper web surface and forms a new solidified surface on which the plastic film is supported and to which the plastic film is firmly bonded.

The preceding paragraphs describe the various features of the preferable blank 30 forming tray 10 as constructed by the present erector described hereinafter.

The Erector

Figure 6:
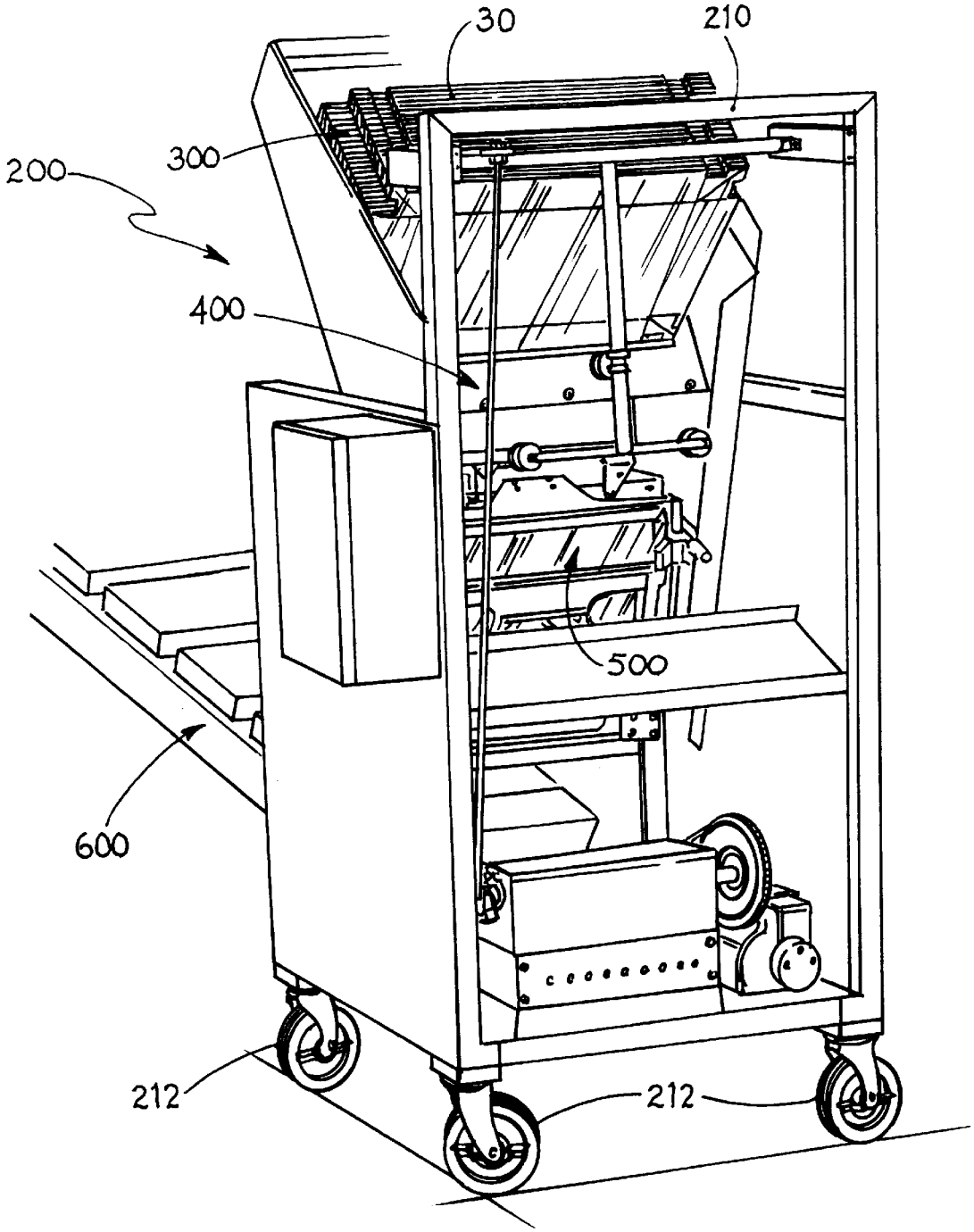
FIG. 6 is a perspective view of a tray erector according to a preferred form of the present invention.
Figure 7:
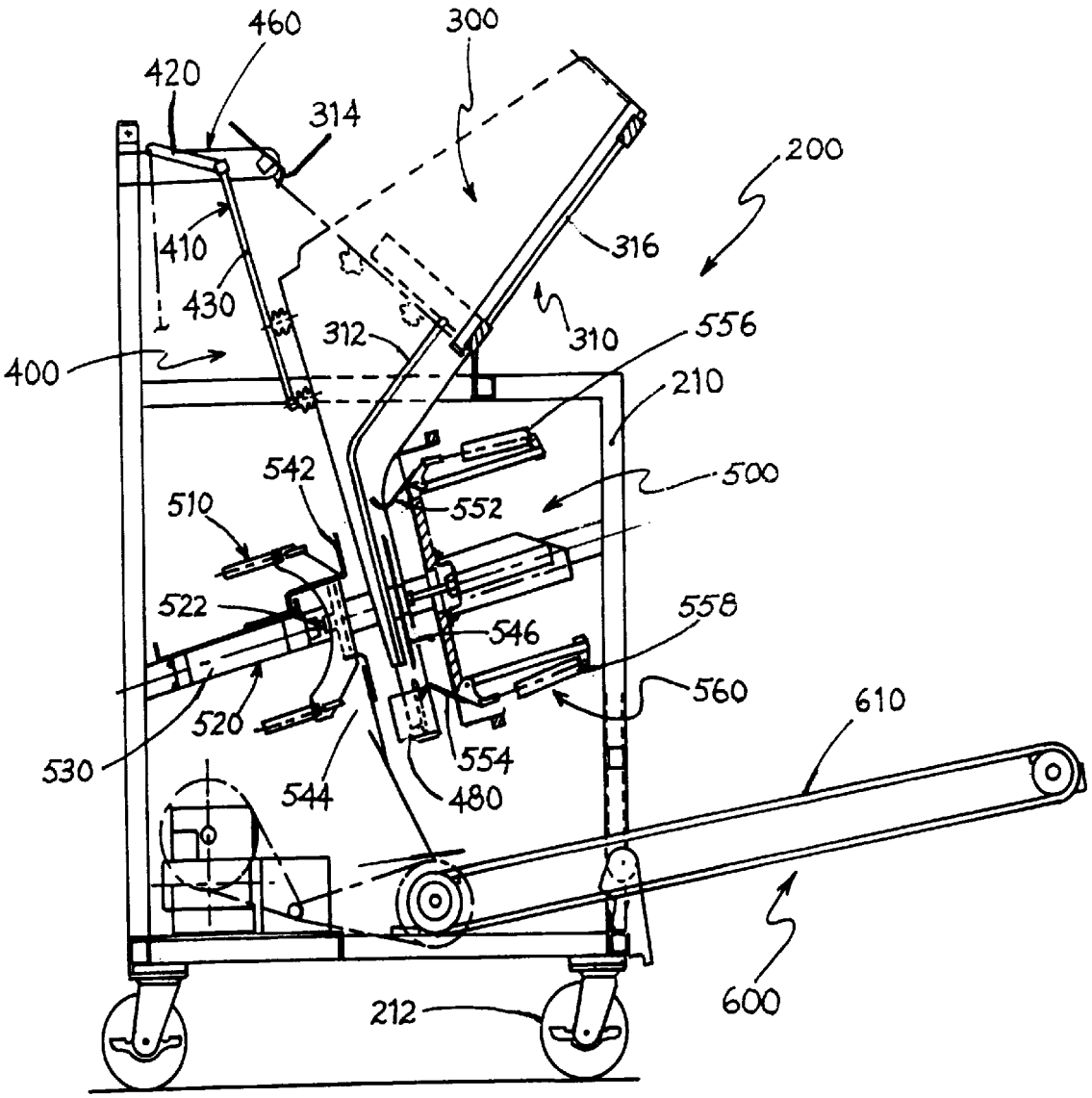
FIG. 7 is a side view of a tray erector according to the present invention.

As shown in FIGS. 6 and 7, the automated tray erector 200 of the present invention that forms the tray 10 from the blank 30 preferably comprises an inventory section 300, a transfer section 400, a construction section 500 and an exit section 600. The present tray erector 200 preferably has a frame 210 suitably configured to present the erector 200 as a single unit. The frame 210 provides a chassis upon which each of the various elements of the present erector 200 may be secured and allows an operator sufficient space between components to navigate inside and around the erector 200 should there be any need to repair the erector 200. Further, the present tray erector 200 has appropriately located guards (not shown) to protect an operator or observer from accidental entanglement with the operating and moving components of the erector 200. Preferably, the guards are transparent and are fixed upon the chassis 210, and are easily removable for inspection of erector 200. The erectors 200 of FIGS. 6 and 7 are movable about a floor space by wheels 212.

The inventory section 300 preferably comprises a hopper 310 having bent flanges 312 and tab stops 314, which hopper 310 stores an inventory of stacked, flat, pre-cut tray blanks 30.

As shown in FIGS. 6–9, in the transfer section 400, a bottom blank 320 of the stacked blanks is transferred from the inventory section 300 to the construction section 500 of erector 200. Transfer section 400 comprises a transfer mechanism 410 that transfers the bottom tray blank 320 forward against the bent flanges 312 of the hopper 310. The transfer mechanism 410 includes a grasping mechanism to grasp the blank 320 in order to transfer it. The blank 320 is then released and slides down the bent flanges 312 to, and rests against, a stop member 480 shown in FIG. 7. Thus, the bottom blank 320 of the inventory of blanks 30 is transferred from the stacked position in the inventory section 300 to a tray-construction position sitting atop stop member 480 in the construction section 500.

The inventory section 300 of the present invention continually positions a bottom tray blank 320 in a pick-up position, wherein the inside face of the blank 30 (preferably laminated) is facing the grasping mechanism 410. Each time the transfer mechanism 410 of transfer section 400 transfers the bottom blank 320 to the construction section 500, a blank 30 previously stacked above the bottom blank 320 is automatically lowered and becomes the new bottom blank 320.

The construction section 500 receives a rectangular blank 30 as it rests atop stop 480, and comprises both a setup assembly 510 and a locking assembly 560. In the setup section 510, the pre-cut and scored end and side panels 50, 52, 70, and 72 of the tray blank 30 are initially folded up from the parallel plane of the bottom panel 32 of the blank 30 in preparation for the locking assembly section 560 of the construction section 500. The locking assembly 560 completes the remaining tray folding and locking, and an erected tray 10 is then produced.

The erected tray 10 then falls from the construction section 500 to the exit section 600, where the tray 10 is guided to an exiting device, preferably a moving delivery conveyor belt 610. The exit section 600 can incorporate a sensing mechanism to detect each tray 10 as it proceeds through the exit section 600, which sensing mechanism is capable of stopping the operation of the present tray erector 200 should an error in tray exiting be detected, thus preventing possible damage to the trays 10 or the erector 200. The exit section can further comprise a stabilizing device 630 that ensures each falling tray 30 consistently lands smoothly onto the exiting device 610. The stabilizing device can be a set of rubber fingers or the like to keep tray 10 from bouncing off the conveyor belt 610 when dropped from the construction section 500.

Construction of the Baking Tray

Figure 8:
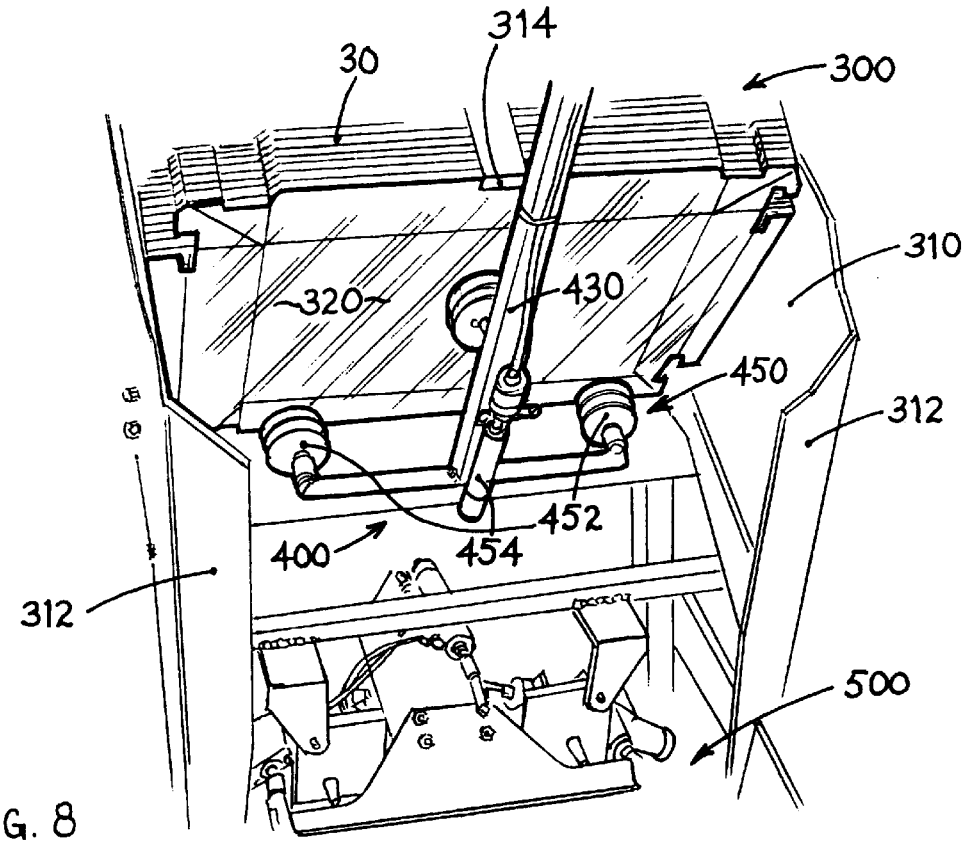
FIG. 8 illustrates the inventory and transfer sections of the present tray erector according to a preferred embodiment.

Initially, flat tray blanks 30 are loaded into the hopper 310, shown stacked in FIGS. 6 and 8. The hopper 310 has a tab stop 314, bottom guide 316 and bent flanges 312. The tray blanks 30 are disposed so the blanks 30 slope forward within hopper 310. Generally, the blanks 30 are positioned in hopper 310 so a blank's 30 side wall 70 or 72 lies adjacent to bottom guide 316, so end wall panels 50, 52 are perpendicular to bottom guide 316. As blank 30 is preferably symmetrical, either side wall 70, 72 may rest upon guide 316. Further, the inside face of each blank 30 faces the grasping mechanism 410, and thus eventually each inside face rests against one or more tab stop 314.

Tab stop 314 extends downward into contact with bottom blank 320 holding back the stack of stacked blanks 30 and is adjustable so as to accommodate the varying widths of different lots of tray blanks 30. The hopper 310 is easily adjusted to accommodate different length and width sizes of blanks 30. The inventory section 300 of the present invention also positions a bottom tray blank 320 into a pick-up position, wherein the bottom tray blank is releasably held in place by tab stop 314 until blank 320 is received by the grasping mechanism 410.

In a preferred embodiment, the hopper 310 is designed to accommodate full size and ¼, ⅓ and ½ size trays, and can hold over 150 blanks stacked one on top of another. Further, such changeover can be completed in less time than presently possible, for example, thirty minutes or less. If the blanks 30 are laminated on one side, it is preferable to have the laminated side (inside face) facing the grasping mechanism 410.

As shown in FIG. 7, the transfer section 400 preferably comprises transfer mechanism 410 including a linked first and second transfer arm 420, 430, and a transfer drive (not shown) for rotating the linked transfer arms 420, 430 (the combination of both first and second transfer arms 420, 430 will sometimes be referred to singularly as the articulated transfer arm 460) through a prescribed angle between the pick-up position of bottom blank 320 and the release position over the construction section 500. In a preferred embodiment, the articulated transfer arm 460 is engaged with the transfer drive at the first transfer arm 420. The transfer drive rotates the articulated transfer arm 460 first through the prescribed angle, and then back in an opposite direction into the bottom blank 320 pick-up position. Alternatively, the transfer arm 460 may not be articulated, but comprise a single integral component.

Transfer arm 430 has a grasping device to grasp the bottom blank 320, so transfer arm 430 can move the bottom blank 320 through tab stop 314 to the release position. Preferably, the grasping device is vacuum assembly 450. The vacuum assembly 450 is carried by the second transfer arm 430 for grasping the inside face of the bottom panel 32 of the bottom blank 320. The vacuum assembly 450 includes vacuum suction cups 452 for engaging the inside face of the blank 320 in the pick-up position. The vacuum suction cups 452 are in communication with a source of vacuum, for example, venturi pump 454 illustrated in FIG. 8. The articulated transfer arm 460 releasably grasps the bottom blank 320 via the suction devices 452 at the pick-up position, and swings the blank 320 into a generally vertical orientation at the release position, as the transfer arm 460 rotates between the pick-up and release positions. The articulating arm 460 feeds the bottom tray blank 320 forward against the bent flanges 312 of the hopper 310, where it is released and slides down the flanges 312 to, and rests atop, stop 480.

Figure 9:
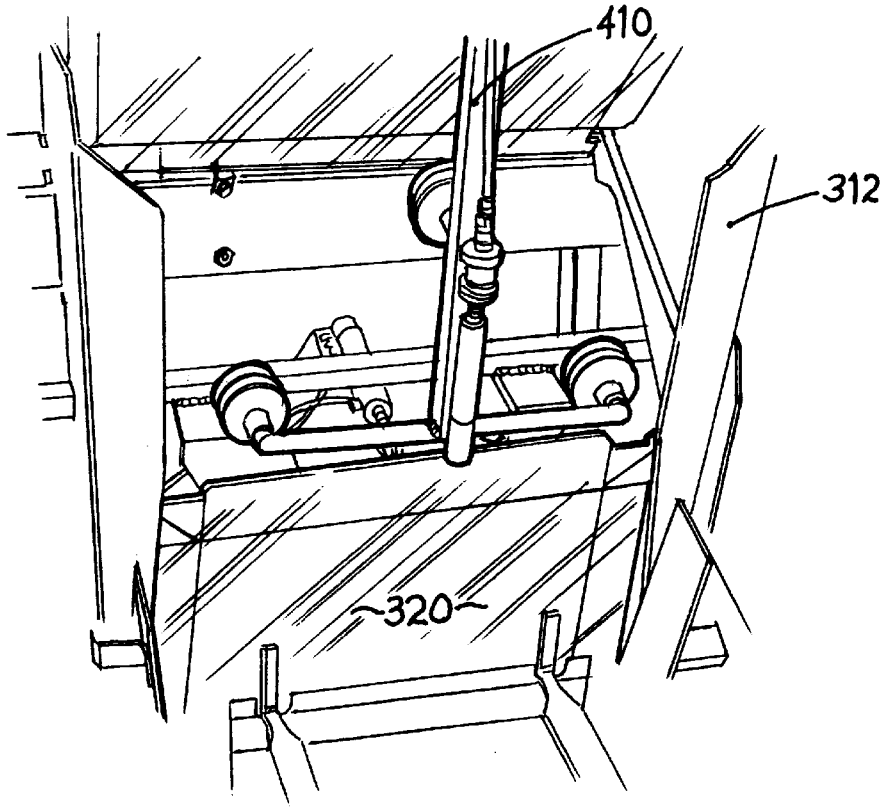
FIG. 9 illustrates the inventory and transfer sections of FIG. 8, wherein the blank has been transferred from the inventory section by the transfer mechanism

As is shown in FIGS. 8 and 9, vacuum assembly 450 preferably has three suction cups 452 configured in such a way so that when the suction cups 452 contact the inside face of bottom blank 320, the blank is releasably secured to transfer arm 460 so that transfer arm 460 can pull bottom blank 320 with enough force to overcome tab stop 314 so that bottom blank 320 may move between the pick-up position and the release position. The blank 320 is released by cutting off the vacuum to the suction cups 452. FIG. 8 illustrates transfer arm 460 ready to engage bottom blank 320 in the pick-up position. In FIG. 9, the transfer arm 460 has moved blank 320 forward against flanges 312 and has released the blank 320 at the release position, wherein the bottom blank 320 has slid down flanges 312 and stopped in the construction section 500.

The construction section 500 constructs the blank 320 (referred now as blank 30) into a tray 10. The blank 30, as described above, can be foldably constructed to form the baking sheet or tray 10, as will now be described in greater detail.

The construction section 500 includes the setup assembly 510 and the locking assembly 560. The setup assembly 510 folds the end and side panels 50, 52, 70 and 72 upward from the plane of the bottom panel 32 of blank 30. The setup assembly 510 comprises a ram assembly 520 having a ram 522 and an actuating means 530 for moving the ram 522 approximately normal to the blank 30. The setup assembly 510 slides between a retracted position and an extended position. The setup assembly 510 preferably further comprises ram tooling plates 542, 544, ejector plate 546, and side folders 552, 554.

Figure 10:
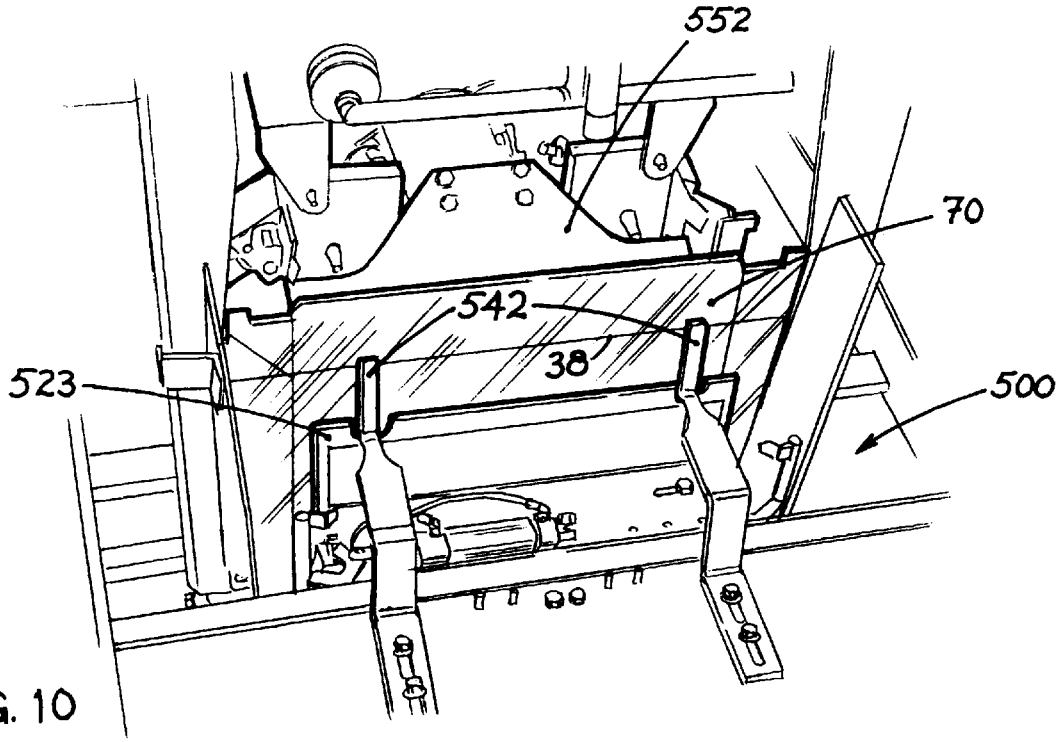
FIG. 10 illustrates the setup assembly of the construction section of the present tray erector according to a preferred embodiment.
Figure 11:
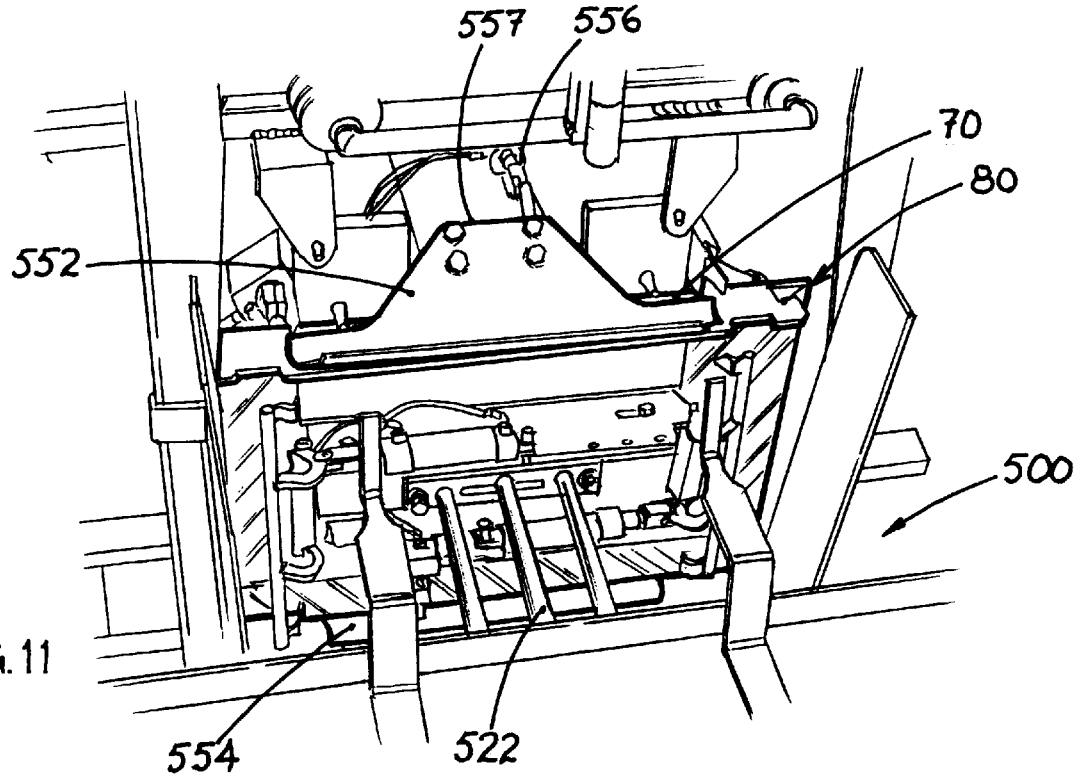
FIG. 11 illustrates the folding of the sides of the blank by the setup assembly of FIG. 10.

As the blank 30 is symmetrical about lines of both vertical and horizontal bisection, so too the construction section 500 comprises several components that are symmetrical both above and below, and to the left and right of, lines of bisection both horizontally and vertically, respectively, of bottom panel 32 of a blank 30. For example, in preferred form, ram tooling plate 542 is identical to ram tooling plate 544, and side folders 552 and 554 are similarly identical. Such design limits the production costs of the present invention. FIGS. 10 and 11 show manipulation of blank 30 in the construction section 500. Description of these and the following figures may detail only one of a set of components. For example, when describing only ram tooling plate 542 and side folder 552, it will be understood that these descriptions are identical to the description of ram tooling plate 544 and side folder 554.

Referring back to FIG. 7, when blank 30 first comes to rest on stop 480, setup assembly 510 is in the retracted position, away from contact with blank 30. In the retracted position, the ram head 523 (shown in FIG. 10) is retracted from contact with blank 30. The ejector plate 546 and locking assembly 560 are located on the other side of blank 30 from the ram 522, also out of contact with blank 30.

The ram 522 with ram head 523 and ram tooling plates 542, 544 is driven by the actuating means 530 to first engage the inner face of the bottom panel 32 of the blank 30, and then continue to extend and exert pressure on the blank 30, trapping it against the ram tooling plates 542, 544 and ejector plate 546. The ram 522 and tooling plates 542, 544 overcome the forces maintaining the blank 30 in its single plane configuration, and press the trapped blank 30 against ejector plate 546 between the side folders 552, 554, thus folding the tray side panels 70 and 72 approximately 90 degrees about first and second side score lines 38, 40 upward from the flat plane, as shown in FIGS. 10 and 11.

The tooling folders 552, 554 preferably are curved so they gently urge side panels 70, 72 to fold about score lines 38, 40 while the ram head 523 continues to push the blank 30 through the aperture between the two folders 552, 554. Upon full extension of ram 522, the side panels 70, 72 are preferably perpendicular to the plane of bottom panel 32 of blank 30, wherein the panel 32 remains sandwiched between ram head 523 and ejector plate 546.

The side panels 70, 72 are then momentarily folded a further approximately 90 degrees and onto the inside face of the bottom panel 32 and released to return approximately perpendicular to the bottom panel 32. The side panels 70, 72 are further folded by the extension of tooling extenders (tooling extender 556 is shown and extends side folder 552). While the ram 522 extends blank 30 between the folders 552, 554, the folders 552, 554 remain fixed in a first position. In order to fold the side panels 70, 72 the further 90 degrees, tooling extender 556 extends the top edge 557 of tooling folder 552 through to a second, extended position. The side folders 552, 554 preferably are rotationally driven about an axis aligned with score lines 38, 40 by tooling extenders (tooling extender 556 is shown in FIG. 11), so that side panels 70, 72 are folded 180 degrees about score lines 38, 40.

As shown in FIG. 11, the length of side folder 552 is preferably shorter than the length of side panel 70 so that the side folder 552 does not interfere with or contact web 80. The side folders 552, 554 are then returned to their first positions. It has been found that rotating side panels 70, 72 through 180 degrees leaves side panels 70, 72 in approximately perpendicular planes to bottom panel 32 upon rotation of side folders 552, 554 back into their first, retracted positions. Depending on the material construction of blank 30, the over-rotation of side panels 70, 72 beyond approximately 90 degrees may need to be less than an additional approximately 90 degrees. It will be understood that the over-rotation may be varied, but should leave the side panels 70, 72 free-standing approximately perpendicular to bottom panel 32.

Figure 12:
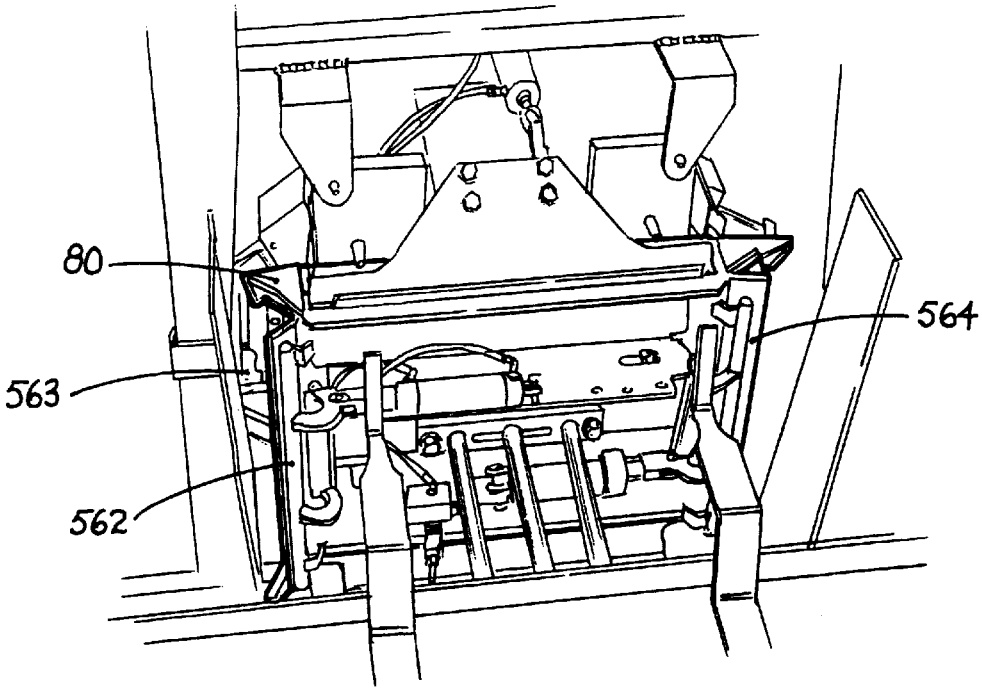
FIG. 12 illustrates the folding of the ends of the blank by the setup assembly of FIG. 10.

After the side panels 70, 72 have been folded, the end panels 50, 52 are then folded approximately perpendicular to bottom panel 32 by end folders 562, 564. The end folders 562, 564 are rotationally driven about an axis aligned with score lines 34, 36 by end extenders (end extender 563 is shown and extends end folder 562) from a retracted position to an extended position so that end panels 50, 52 are folded approximately 90 degrees about score lines 34, 36. As shown in FIG. 12, the length of end folder 562 is preferably shorter than the length of end panel 50 so that the end folder 562 does not interfere with or contact web 80.

Upon the folding of the end panels 50, 52, the four corner webs 80 are themselves kicked outward (due to scoring of the blank 30 and the completed folding of side panels 70, 72), ending up folded 180 degrees onto themselves, and sticking out on all four corners of the tray 10, as shown in FIG. 12. At this point in time, the side folders 552, 554 are in their retracted positions, and the end folders 562, 564 are in their extended positions. The end folders 562 and 564 contact the outside surfaces of the end panels 50 and 52 of blank 30, and fold these panels about their respective score lines.

Figure 13B:
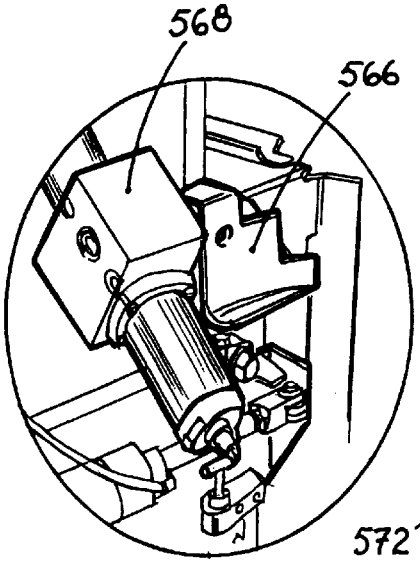
FIG. 13*b* illustrates the flippers and actuators of the locking assembly of FIG. 13*a*.
Figure 13A:
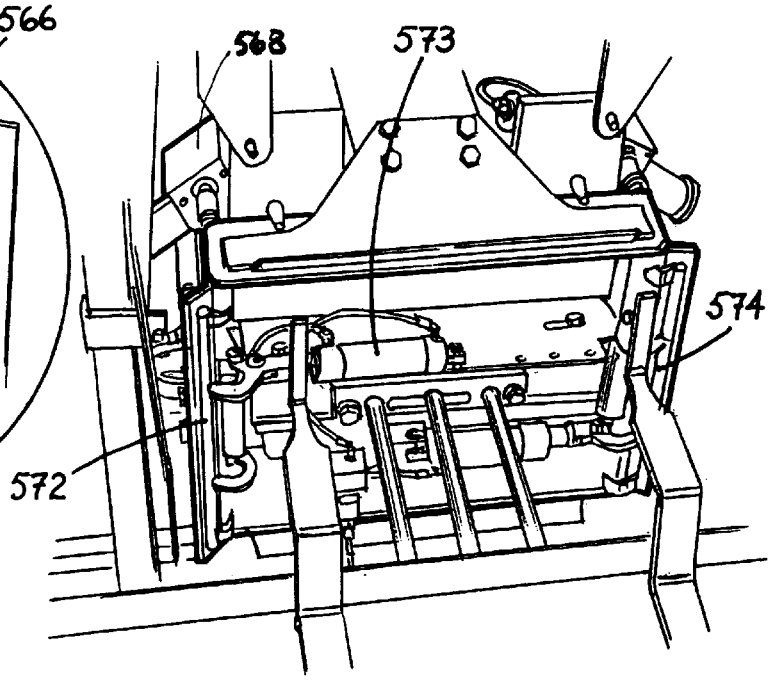
FIG. 13*a* illustrates the locking of the sides and ends of the blank by the locking assembly of the present erector according to a preferred embodiment.

The locking assembly 560 then folds the four folded corner webs 80 by four flippers 566, mounted on four preferably 180 degree actuators 568, against the end panels 50, 52 as shown in FIGS. 13*a* and 13*b*. Referring specifically to corner web 80A, the corner web 80A is folded outwardly and about the diagonal score line 86, so that the corner web 80A forms flap 120 extending outwardly from the corner formed at the edge where score fines 82, 84 meet, as seen best in FIG. 2. The flap 120 comprises generally triangular elements having top locks 122 extending upwards from their top edges 124. In reference to the blank of FIG. 4, the flap 120 comprises generally triangular elements having top locks 94, 96 extending upwards from bottom cutout lines or bottom edges 90*b*, 92*b* along side edges 90*s*, 92*s*. As the flap 120 comprises the corner web 80A folded upon itself at diagonal score line 86, the flap 120 (and the top locks 122 thereon) have a total thickness of twice the thickness of the laminated paperboard comprising the blank 30.

Extension 86*a* of score line 86 into the bottom panel 32 ensures that the juncture point of folding at each corner of bottom panel 32 (for example, the intersection of first end score line 34 and first side score line 38) does not interfere with the folding of corner webs 80 to form flaps 120.

The flap 120 is next folded outwardly onto the exterior surface of the first end 18 by a flipper 566, as the flap 120 is shown by FIG. 1. When the flap 120 is folded against the end 18, the top edges 124 of the flap 120 are preferably adjacent, or incrementally below, the lower perforations 63*a* of the hinged fold joints 58, and the top locks 122 lie alongside the perforated sections 60, 62 and extend upwards a distance above the retaining slit 64 to facilitate locking and unlocking.

Figure 14:
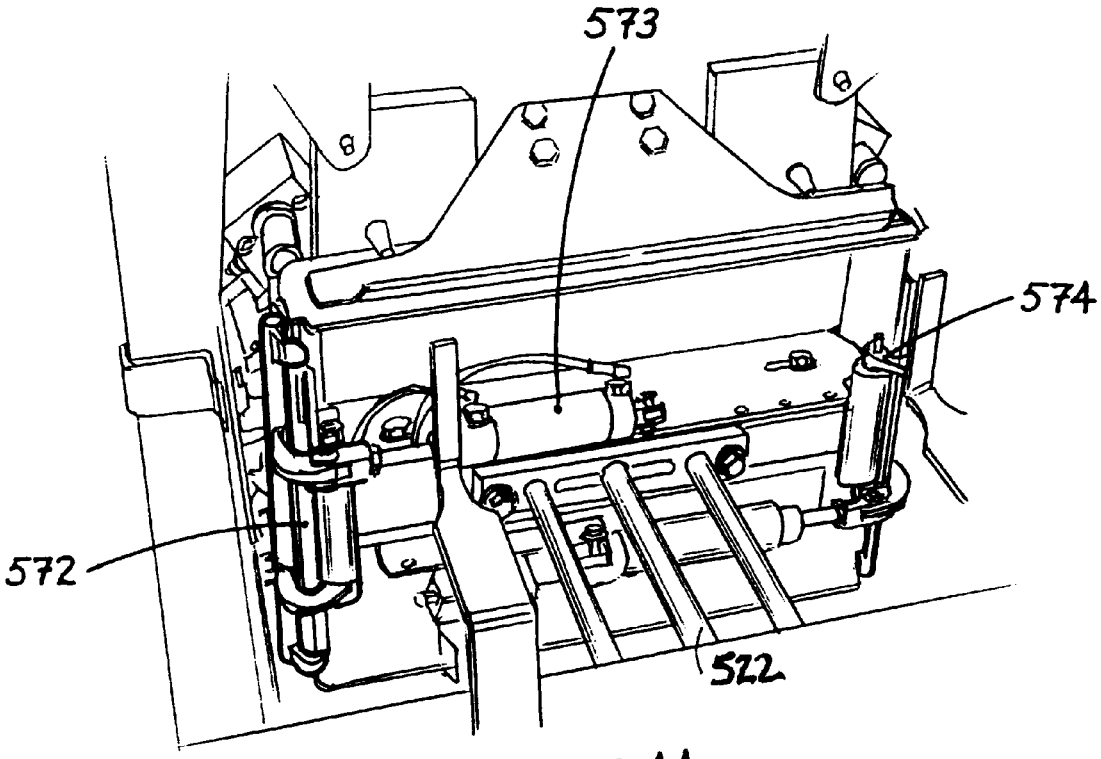
FIG. 14 illustrates the folding of the flap panel over the locking tabs of the corner web by the locking bars.

Next, the flap panel 56 is then folded downward along the hinged fold joint 58, towards the exterior of the baking tray 10, as seen best in FIG. 1, by the rotation of locking bars 572, 574, shown in FIG. 14, whereupon the locks 122 are engaged within the retaining slit 64. The flipper 566 must keep flap 120 in proximity to end 18 long enough so rotation bar 572 can rotate flap panel 56 and the retaining slit 64 over lock 122.

The locking bar 572 is rotationally driven about an axis aligning with retaining slit 64 by bar extender 573 from a retracted position to an extended position so that flap panel 56 is folded approximately 180 degrees about retaining slit 64. Thus, locking bar 572 must move from a position inside the forming tray, through initial contact with flap panel 56, then rotating flap panel 56 approximately 180 over retaining slit 64, finally ending up on the outside face of flap panel 56 outside the tray.

Because the locks 122 extend upwards a distance, preferably at least the thickness of the material comprising the blank 30, above the retaining slit 64, the locks are retained within the retaining slit 64, and also secure the flaps 120 against unfolding away from the end walls 18, 20 of the baking tray, thereby forming a substantially rigid, leakproof corner.

Figure 2:
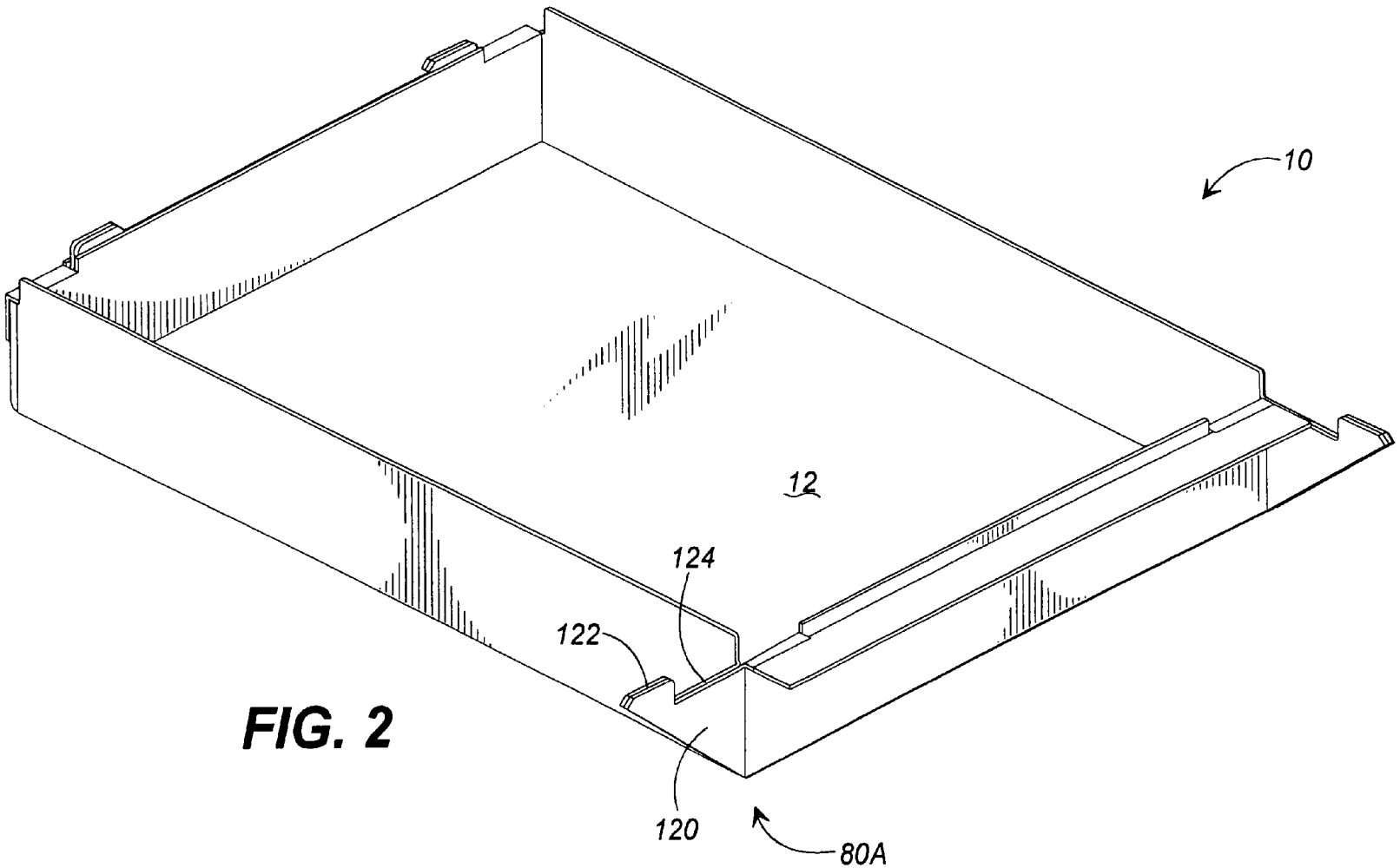
FIG. 2 shows the foldable laminated corrugated paperboard container of FIG. 1, in a partially assembled configuration for illustrative purposes.

A knifecut portion 87 is preferably provided near the outer corner 80A of representative corner web 80A as shown in FIGS. 2 and 4 to eliminate a wide rolling fold that typically occurs from the end of the knifecut 87 to the juncture of score lines 34, 38, if corner web 80A did not have knifecut 87. Knifecut 87 and score line 86 form the two top locks 94, 96, and allow the locks 94, 96 to work independently of one another as the flap panel 56 is folded downward along the hinged fold joint 58. The knifecut portion 87 ensures the proper insertion of the locks 122 up through retaining slit 64, and the proper holding of the flaps 120 form the tray 10.

Knifecuts 67 centered along perforations 63*a* and 63*b* ensure the proper rollover of the perforated section 60 over the double thickness of rectangular cutouts 90, 92, which also aid in forming the proper locking and holding position for the locked tray 10.

Moreover, because the spacing s between the perforations 63*a*, 63*b* is at least twice, and preferably four times the thickness of the laminated paperboard comprising the blank 30, the width of the retaining slit 64 in the assembled configuration of the baking tray 10 provides a positive locking action when the top locks 122 are engaged within the retaining slit 64, without the necessity of gluing. This positive locking feature results in part from the provision of a retaining slit 64 which, when the container is assembled and the flap panel 56 is folded downwardly adjacent the end wall panel 54, opens to a width of approximately twice the thickness of the stock comprising the blank 30 when the spacing s between perforations 63*a*, 63*b* is approximately four times the thickness of the stock comprising the blank 30 (owing to the thickness of the end wall panel 54 and flap panel 56). When the spacing between the perforations 63*a*, 63*b* is less than four times the thickness of the stock comprising the blank 30, the width of the retaining slit 64 in the container's assembled configuration will, correspondingly, be less than twice the stock's thickness. In this manner, the retaining slit 64 is of approximately the same thickness as, or somewhat less than, the thickness of the locks 122 that are retained therein.

The corners of the baking sheet of the present invention do not present any openings from which fluid contents can leak. The fluid contents remain enclosed within tray 10 up to the height of top edges 124 of flaps 120.

Figure 15:
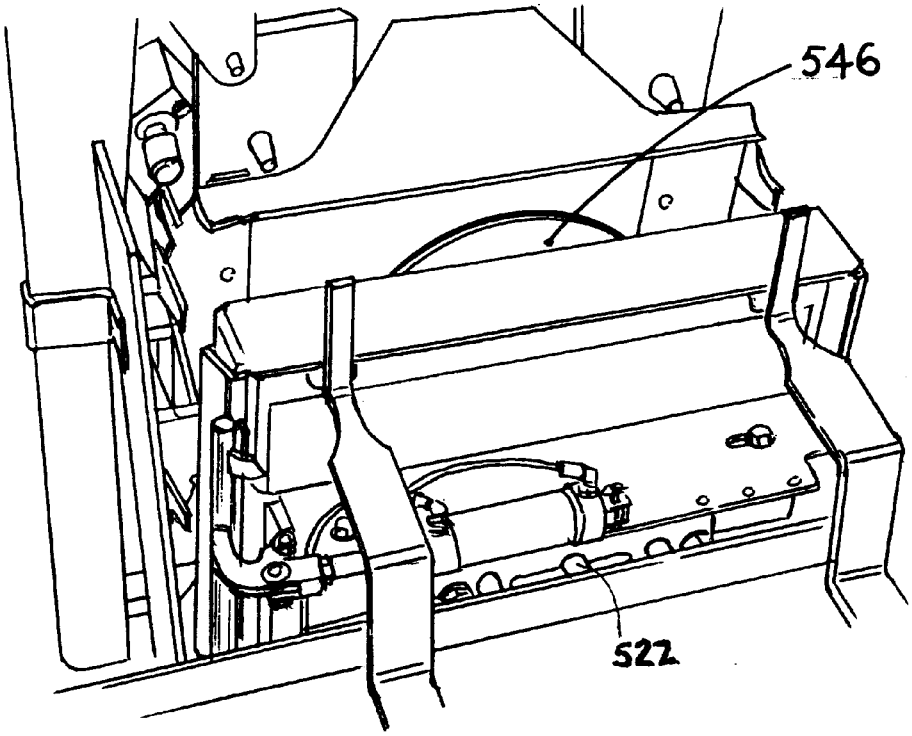
FIG. 15 illustrates the ejector plate moving the erected tray out from the tray's construction location and into the exit section of the present erector.
Figure 16:
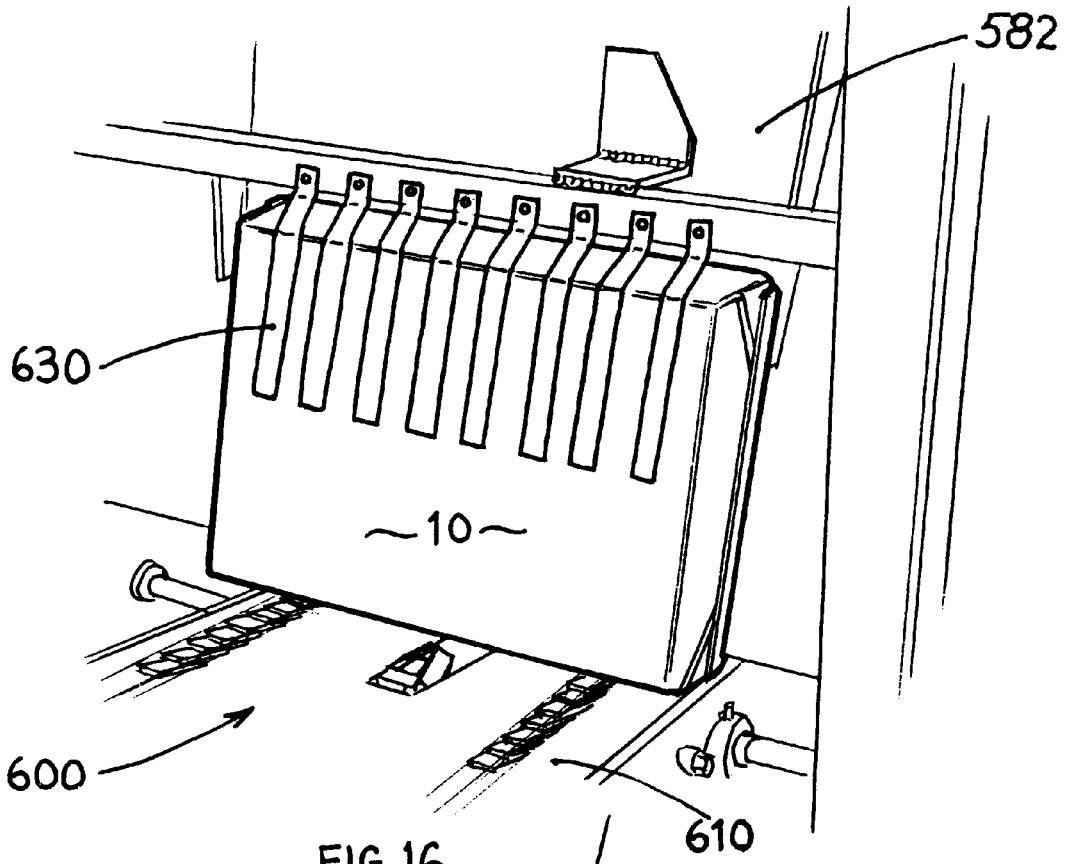
FIG. 16 illustrates the exit section of the present tray erector according to a preferred embodiment.
Figure 17:
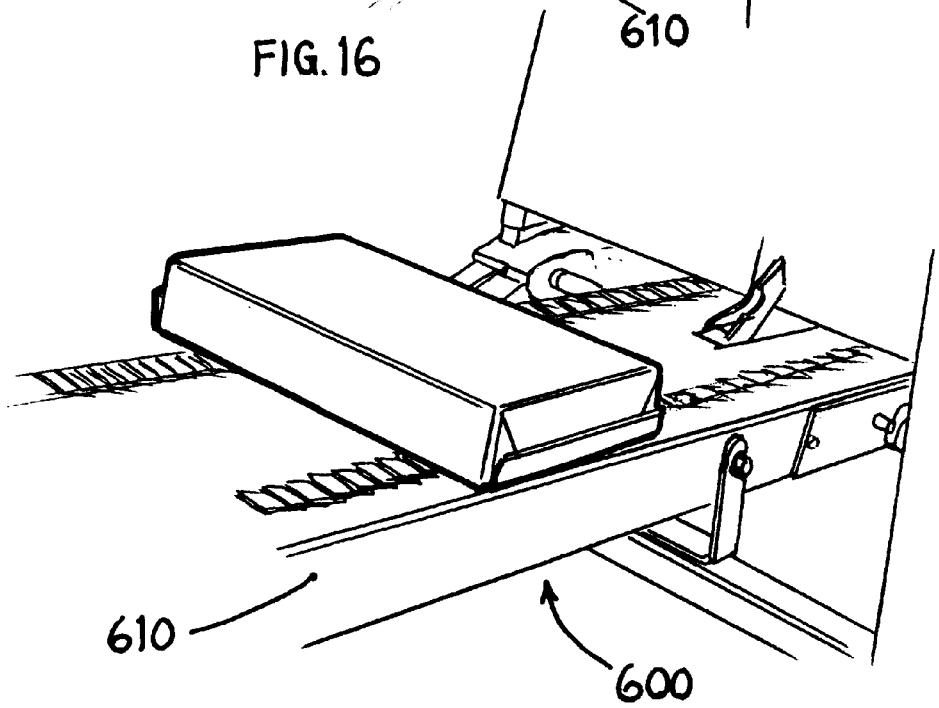
FIG. 17 illustrates the conveyor mechanism of the exit section of FIG. 16.

Upon completion of the locking steps by the locking assembly 560, each tooling component is returned to its retracted position, and the ejector plate 546 is moved in the opposite direction it was initially pushed by the ram 522. The finished tray 10 is then ejected from the tooling by the ejector plate 546, and stripped from plates 542, 544 as the ram cylinder 522 retracts, shown in FIG. 15. As the ram 522 retracts, the completed tray 10 slides down the guide plate 582 and onto the moving delivery conveyor belt 610 of the end section 600 shown in FIGS. 16 and 17.

The exit section 600 can further comprise a sensor beam assembly (not shown) to detect the tray 10 as it drops onto the conveyor belt 610, automatically stopping the erector 100 if a tray 10 is not detected by a certain time, preventing possible tooling damage. If a tray 10 is detected each time, the erector 100 continues to run.

The erector 100 can be changed over to form assorted tray sizes by adjusting the above-described components. Further, the erector 100 comprises movement means to power the various components of the erector 100. The movement means can be a variety of power and translation of power embodiments, for example, vacuum and cam controls. All folding and vacuum preferably is air powered. In one embodiment, the erector utilizes 80 psi with 5 cfm, and start, stop; safety switches, sensors and conveyor belt are electric and operate on 110–120 Volts.

The present tray erector can run at a variety of speeds, and preferably can be set to run a fixed speed of up to 25–28 cycles per minute. Once set for a specific speed, a variable speed range of plus or minus ten percent from the fixed speed may be used. In a preferred form, the weight of the present tray erector 100 is approximately 450 pounds, and is designed with caster 212 having brakes, to allow for easy movement and storage. Further, the relatively small size of the erector, in one embodiment 36' long×28' wide×64' high, adds to the mobility for easily placing the erector in line with the product filler.

In use, the above-described blank 30 can be assembled to form a baking tray 10 as described, according to the above-described assembly method. Fluid contents, such as, for example, cake batter can be introduced to the interior of the baking tray 10. Owing to the closed nature of the corners, as described above, the baking tray 10 resists leakage of any contents. The baking tray 10 can then be used for baking, storing and shipping products in a variety of applications. In addition, the flap panels 56, which are folded outwardly and downwardly along the exterior of the first and second end walls 18, 20 in the assembled configuration of the baking tray 10 provide convenient gripping edges for handling the assembled baking tray 10, and do not interfere with the contents of the tray. The "roll-over lock" permits the tray to open and some of the contents to be removed, for example by a spatula, and re-locked by hand for storage.

While the invention has been disclosed in its preferred forms, it will be apparent to those skilled in the art that many modifications, additions, and deletions can be made therein without departing from the spirit and scope of the invention and its equivalents as set forth in the following claims.

What is claimed is:

1. An automated erector for erecting an open top container having corners from a generally flat blank, the blank having a bottom panel bounded by end and side score lines, first and second end panels connected to the opposite ends of the bottom panel at the respective end score lines, first and second side panels connected to the opposite sides of the bottom panel at the respective side score lines, and corner webs adjacent each corner of the bottom panel between an adjacent end and side panel, each corner web having a top lock, each of the first and second end panels having a flap panel each flap panel connected to each end panel by a hinged fold joint having a retaining slit for receiving the top locks of the adjacent corner web, said erector comprising:

(a) an inventory section including a hopper with a releasable retainer, said hopper capable of storing an inventory of stacked blanks;

(b) a construction section including a setup assembly and a locking assembly, said construction section capable of transforming the blank into the open top container;

(c) a transfer section that transfers a blank from said hopper to said construction section, said transfer section including a transfer mechanism to transfer the blank from a pick-up position to a release position; and (d) an exit section where an erected open top container exits the automated erector;

said setup assembly of said construction section (b) being capable of folding the first and second end panels of the blank approximately 90 degrees from the plane of the bottom panel about the respective end score lines, and being capable of folding the first and second side panels of the blank approximately 90 degrees from the plane of the bottom panel about the respective side score lines, wherein while the first and second end and side panels are being folded, the corner webs extend out to form corner flaps each having a top lock;

said locking assembly of said construction section (b) incorporating actuators with flippers mounted on said actuators, said flippers being capable of folding the corner flaps against the folded end panels, wherein the folding of the corner flaps provide the open top container with leakproof corners; and said locking assembly further incorporating a flap panel locking mechanism being capable of lowering the flap panel over the corner flaps so the top locks of the corner flaps are engaged in the retaining slit in the hinged fold joint.

2. The erector of claim 1, further comprising:

(a) a frame to which said sections are fixed; and (b) guards secured to said frame to protect an operator or observer from accidental entanglement with the operating and moving components of the erector.

3. The erector of claim 1, wherein said transfer section (c) further comprises a grasping mechanism to releasably grasp a blank from said hopper at a pick-up position, wherein said transfer mechanism transfers a blank forward against bent flanges of said hopper at which point said grasping mechanism releases the blank.

4. The erector of claim 3, wherein said exit section (d) comprises a moving delivery conveyor belt for transferring the erected open top container away from the automated erector.

5. The erector of claim 4, wherein said exit section (d) further comprises a sensing mechanism to detect each erected open top container as it exits the automated erector.

6. The erector of claim 5, wherein said exit section (d) further comprises a stabilizing device that stabilizes each exiting container so an exiting container does not interfere with subsequently exiting containers.

7. The erector of claim 1, wherein said setup assembly of said construction section (b) comprises:

(i) a ram assembly having a ram and an actuator, said actuator capable of moving said ram back and forth approximately normal to the blank between a retracted position and an extended position;

(ii) side folders forming an aperture between which the blank is extended by said ram, said side folders folding the sides of the blank approximately perpendicular to the bottom panel of the blank; and (iii) an ejector plate;

wherein when the blank is released from said grasping mechanism at the release position, the blank falls into said construction section and comes to rest upon a stop, such that the blank is positioned between said retracted ram and said ejector plate, and wherein, upon extension, said ram traps the bottom blank between said ram on one side and said ejector plate on the other.

8. The erector of claim 7, wherein said setup assembly of said construction section (b) further comprises:

(a) side tooling extenders that rotate said side folders so the side panels of the blank are folded beyond approximately perpendicular to the bottom panel of the blank;

(b) end folders that fold the ends of the blank approximately perpendicular to the bottom panel of the blank; and (c) end tooling extenders that rotate said end folders.

9. The erector of claim 8, wherein said flap panel locking assembly comprises locking bars, said locking bars rotationally driven about an axis parallel to the retaining slit by a bar extender.

10. The erector of claim 9, wherein said side folders are curved to urge the side panels of the blank to fold about the side score lines while said ram continues to push the blank through the aperture between said side folders.

11. An automated erector for erecting a tray having corners from a generally flat blank, the blank having a bottom panel bounded by end and side score lines, first and second end panels connected to the opposite ends of the bottom panel at the respective end score lines, first and second side panels connected to the opposite sides of the bottom panel at the respective side score lines, and corner webs adjacent each corner of the bottom panel between an adjacent end and side panel each corner web having a top lock, each of the first and second end panels having a flap panel flap panel connected to each end panel by a hinged fold joint having a retaining slit for receiving the top locks of the adjacent corner web, said erector comprising:

(a) an inventory section including a hopper having bent flanges, a bottom guide and a tab stop capable of holding back a stack of blanks;

(b) a construction section including a setup assembly and a locking assembly, said construction section capable of transforming the blank into the erected tray;

(c) a transfer section that transfers a blank from said hopper to said construction section, said transfer section including a transfer mechanism to transfer the blank from a pick-up position to a release position; and (d) an exit section where the tray exits the automated erector;

said setup assembly of said construction section (b) being capable of folding the first and second end panels of the blank approximately 90 degrees from the plane of the bottom panel about the respective end score lines, and being capable of folding the first and second side panels of the blank approximately 90 degrees from the plane of the bottom panel about the respective side score fines, wherein while the first and second end and side panels are being folded, the corner webs extend out to form corner flaps each having a top lock;

said locking assembly of said construction section (b) incorporating actuators with flippers mounted on said actuators, said flippers being capable of folding the corner flaps against the folded end panels, wherein the folding of the corner flaps provide the tray with leak-proof corners; and said locking assembly further incorporating a flap panel locking mechanism being capable of lowering the flap panel over the corner flaps so the top locks of the corner flaps are engaged in the retaining slit in the hinged fold joint.

12. The erector of claim 11, further comprising:

(a) a frame to which said sections are fixed;

(b) guards secured to said frame to protect an operator or observer from accidental entanglement with the operating and moving components of the erector; and (c) movement means fixed to said frame to enable movement of the frame.

13. The erector of claim 12, wherein said transfer section (c) further comprises a grasping mechanism to releasably grasp a blank from said hopper at a pick-up position, wherein said transfer mechanism transfers a blank forward against bent flanges of said hopper at which point said grasping mechanism releases the blank.

14. The erector of claim 1, wherein said transfer section (c) includes a linked first and second transfer arm, and a transfer drive for rotating the linked transfer arms through a prescribed angle between the pick-up position and the release position over said construction section (b).

15. The erector of claim 14, wherein said grasping mechanism comprises a releasable vacuum suction device.

16. The erector of claim 15, wherein said exit section (d) comprises:

(a) a moving conveyor belt;

(b) a sensing mechanism to detect each tray as it exits the erector onto said conveyor belt; and (c) a stabilizing device that stabilizes each exiting tray so an exiting tray does not interfere with subsequently exiting trays.

17. A method of folding a generally flat blank into a tray having corners with an automated erector, the blank having a bottom panel bounded by end and side score lines, first and second end panels connected to the opposite ends of the bottom panel at the respective end score lines, first and second side panels connected to the opposite sides of the bottom panel at the respective side score lines, and corner webs adjacent each corner of the bottom panel between an adjacent end and side panel each corner web having a top lock, each of the first and second end panels having a flap panel, with a flap panel connected to each end panel by a hinged fold joint having a retaining slit for receiving the top locks of the adjacent corner web, said method comprising the steps of (a) providing an inventory of blanks in a hopper having bent flanges and a tab stop, said hopper capable of storing an inventory of stacked blanks, said tab stop extending into contact with a bottom blank of the stacked blanks, holding back the stack of stacked blanks;

(b) transferring the bottom blank of the inventory of blanks to a construction section, said step of transferring using a transfer mechanism to transfer the blank from a pick-up position to a release position and a grasping mechanism to releasably grasp the bottom blank at the pick-up position, wherein said transfer mechanism transfers the bottom blank forward against said bent flanges of said hopper where said grasping mechanism releases the bottom blank at the release position;

(c) folding the first and second end panels of the blank approximately 90 degrees from the plane of the bottom panel about the respective end score lines, and folding the first and second side panels of the blank approximately 90 degrees from the plane of the bottom panel about the respective side score lines, wherein while the first and second end and side panels are being folded, the corner webs extend out to form flaps each having a top lock;

(d) folding the corner flaps against the folded end panels with flippers mounted on actuators panels, wherein the folding of the corner flaps provide the tray with leak-proof corners; and (e) folding each flap panel downward over the corner flaps so the top locks of the corner flaps are engaged in the retaining slit in the hinged fold joint.

18. The method of claim 17, said step (c) of folding incorporating the use of:

(i) a ram assembly having a ram and an actuator, said actuator capable of moving said ram back and forth approximately normal to the blank between a retracted position and an extended position;

(ii) side folders forming an aperture between which the blank is extended by said ram, said side folders folding the sides of the blank approximately perpendicular to the bottom panel of the blank; and (iii) an ejector plate;

wherein when the bottom blank is released from said grasping mechanism at the release position, the blank falls into said construction section and comes to rest upon a stop, such that the blank is positioned between said retracted ram and said ejector plate, and wherein, upon extension, said ram traps the bottom blank between said ram on one side and said ejector plate on the other.

19. The method of claim 18, wherein said folding step (c) further comprises using:

(a) side tooling extenders that rotate said side folders so the side panels of the blank are folded beyond approximately perpendicular to the bottom panel of the blank;

(b) end folders that fold the ends of the blank approximately perpendicular to the bottom panel of the blank; and (c) end tooling extenders that rotate said end folders.

20. The method of claim 19, wherein said folding step (e) further comprises using locking bars, each said locking bar capable of rotating each flap panel downward over the corner flaps, said locking bar rotationally driven about an axis parallel to the retaining slit by a bar extender.

21. A method of foldably constructing a tray with an automated erector comprising the following steps:

(a) providing a blank having leak-proof corner constructions, the blank having a bottom panel bounded by end and side score lines, first and second end panels connected to the opposite ends of the bottom panel at the respective end score lines, first and second side panels connected to the opposite sides of the bottom panel at the respective side score lines, and the leak-proof corner constructions, the corner constructions being corner webs adjacent each corner of the bottom panel between an adjacent end and side panel, each corner web having a top lock, each of the first and second end panels having a flap panel, with a flap panel connected to each end panel by a hinged fold joint having a retaining slit for receiving the top locks of the adjacent corner webs;

(b) folding the first and second end panels and the first and second side panels of the blank with the automated erector, the automated erector folding the first and second end panels of the blank approximately 90 degrees from the plane of the bottom panel about the respective end score lines, and folding the first and second side panels of the blank approximately 90 degrees from the plane of the bottom panel about the respective side score lines, wherein while the first and second end and side panels are being folded, the corner webs extend out to form flaps each having a top lock;

(c) folding the leak-proof corner constructions with the automated erector against the folded end panels such that the corner constructions remain leakproof upon folding; and (d) folding downward each flap panel, and over the corner flaps, with the automated erector so the top locks of the corner flaps are engaged in the retaining slit in the hinged fold joint.

22. The method of claim 21, said step (c) of folding the leak-proof corner constructions incorporating the use of actuators with flippers mounted on said actuators, said flippers being capable of folding the leak-proof corner constructions against the folded end panels.

23. The method of claim 21 further comprising the step (e) storing an inventory of the blanks in a hopper, the inventory of stacked blanks including a bottom blank being the blank of step (a), the bottom blank being folded through said steps (b), (c) and (d).

24. The method of 21 further comprising the step (e) of exiting the foldably constructed tray from the erector, said exiting step (e) incorporating a movable conveyor belt, a sensing mechanism to detect each tray as it exits the erector onto said conveyor belt, and a stabilizing device that stabilizes each exiting tray so an exiting tray does not interfere with subsequently exiting trays.

* * * * *